US010000895B2

(12) United States Patent
Beckhusen

(10) Patent No.: US 10,000,895 B2
(45) Date of Patent: Jun. 19, 2018

(54) ROTATING HYDRAULIC GEAR MOTOR

(71) Applicant: Caterpillar Inc., Peoria, IL (US)

(72) Inventor: Jordan Beckhusen, Robinson, TX (US)

(73) Assignee: Caterpillar Inc., Deerfield, IL (US)

( * ) Notice: Subject to any disclaimer, the term of this patent is extended or adjusted under 35 U.S.C. 154(b) by 0 days. days.

(21) Appl. No.: 15/287,248

(22) Filed: Oct. 6, 2016

(65) Prior Publication Data

US 2018/0100276 A1 Apr. 12, 2018

(51) Int. Cl.

| | |
|---|---|
| ***E01C 19/00*** | (2006.01) |
| ***E01C 19/38*** | (2006.01) |
| ***E02D 3/046*** | (2006.01) |
| ***B06B 1/16*** | (2006.01) |
| *F01C 1/18* | (2006.01) |

(52) U.S. Cl.

CPC ..... *E01C 19/38* (2013.01); *B06B 1/161* (2013.01); *E02D 3/046* (2013.01); *F01C 1/18* (2013.01)

(58) Field of Classification Search

CPC ..... E01C 19/38; E02D 3/046; B06B 1/161; F01C 1/18

USPC ..... 404/113, 133.05–133.2

See application file for complete search history.

(56) References Cited

U.S. PATENT DOCUMENTS

| | | | | |
|---|---|---|---|---|
| 3,481,275 | A | 12/1969 | Gelin | |
| 4,830,592 | A | 5/1989 | Weidhaas | |
| 5,088,565 | A * | 2/1992 | Evarts | E02D 7/18 173/49 |
| 5,752,571 | A * | 5/1998 | Sapozhnikov | B25D 9/18 173/13 |
| 6,135,741 | A | 10/2000 | Oehman, Jr. | |
| 7,736,139 | B2 | 6/2010 | Sorby | |
| 2001/0024618 | A1 | 9/2001 | Winmill | |
| 2013/0025385 | A1 * | 1/2013 | Renz | B06B 1/186 74/61 |
| 2016/0265528 | A1 * | 9/2016 | Ferretti | F04C 2/084 |
| 2018/0023561 | A1 * | 1/2018 | Rossi | F04C 2/107 |

FOREIGN PATENT DOCUMENTS

| | | | |
|---|---|---|---|
| WO | 2003074876 | A1 | 9/2003 |
| WO | 2015083458 | A1 | 6/2015 |

* cited by examiner

*Primary Examiner* — Raymond W Addie

(74) *Attorney, Agent, or Firm* — The Law Office of Kurt J. Fugman LLC

(57) ABSTRACT

A rotating hydraulic gear motor for use with vibratory compactors, includes a long shaft and a first gear attached to the long shaft, a short shaft and a second gear attached to the short shaft, the second gear meshing with the first gear. A yoke bushing member includes a first aperture and a second aperture that are spaced away from each other a predetermined distance. The long shaft is disposed in the first aperture of the yoke bushing member and the short shaft is disposed in the second aperture.

10 Claims, 8 Drawing Sheets

ROTATING HYDRAULIC GEAR MOTOR

TECHNICAL FIELD

The present disclosure relates to vibratory plate compactors. More particularly, the present disclosure is related to a vibratory plate compactor uses hydraulic fluid to power the vibration mechanism.

BACKGROUND

Vibratory compactors are routinely used in the construction industry and the like to compact soil or other work surfaces. These are often attached to mobile machines that include a cab that houses an operator that controls the operation of the vibratory compactor. These compactors often include a vibration mechanism such as an eccentric device that causes a plate to move up and down in a rapid or vibratory manner to effectuate the flattening of the work surface. The vibration mechanism is often hydraulically powered.

In many applications, the eccentric device includes an eccentric mass that is coupled to a shaft using a spline, key or other type of coupler which is prone to wear out due to the vibration of the mechanism as well as the inertial forces associated with stopping and starting the vibration of the mechanism.

Looking now at FIG. 1, a perspective view is shown of a machine 100 using a vibratory plate compactor assembly 200 according to a prior art design used to compact densifiable strata 128, such as ground soil, road base material, or paving material. The machine 100 that is compatible with a vibratory plate compactor assembly 200, that is to say, a coupling device 102 is provided so that the vibratory plate compactor assembly 200 may be attached to the machine and be controlled by the machine 100. In this embodiment, the coupling device 102 is located at the free end 104 of the boom 106 opposite the end 108 of the boom 106 that is attached to the turn table 130 of the machine 100. The machine 100 further comprises a controller 110, a motor 112, a wheel or track undercarriage 114 that is driven by the motor 112, and the vibratory plate compactor assembly 200 that is attached to the boom 106 of the machine 100 using the coupling device 102 as already mentioned. The controller 110 is in communication or operative association with the controls 116 provided in the cab 118 so that the operator may control the movement and function of various parts and systems of the machine 100.

More specifically, the machine 100 depicted in FIG. 1 is a large excavator but it is contemplated that other machines such as backhoes and the like could also use a vibratory plate compactor assembly 200 according to any embodiment of the present disclosure. Furthermore, the machine 100 is mobile on a track driven undercarriage 114 but a more conventional wheel or tire type undercarriage may also be used that is powered by the motor 112. For this machine 100, the motor 112 comprises an internal combustion engine but other motors such as an electric motor could be used for other embodiments. In addition, hydraulic hoses 120 connect the cylinders 122 that move the linkage members 124 of the boom 106 to a hydraulic manifold 126. Similarly, hydraulic hoses 120' connect the vibration mechanism 202 of the vibratory plate compactor assembly 200 to the manifold 126 (shown in hidden lines). A hydraulic pump (not shown) provides the hydraulic fluid necessary to rotate or otherwise drive the eccentric mechanism 204 that is part of the vibration mechanism 202. The movement of the boom 106 and powering of the vibration mechanism 202 may be achieved by other devices or methods in other embodiments such as by mechanical or electrical power, etc.

Turning now to FIG. 2, the coupling device 102 that connects the vibratory plate compactor assembly 200 to the machine 100 can be seen more clearly as well as the hydraulic hoses 120' that connect the vibration mechanism 202 to the hydraulic manifold 206 (shown by hidden lines) of the assembly 200 and system of the machine via hoses 120. The assembly includes an adapter subassembly 208 that is attached to the top plate 210 of the assembly 200 using fasteners, welding, etc. The adapter subassembly 208 includes a first side plate 220 with two ear portions 212 that define pin receiving bores 214 and a second side plate 216 with two ear portions 218 that define pin receiving bores that are aligned concentrically with the pin receiving bores 214 of the first side plate 220. Only one side may be clearly seen as the other side is obstructed by the boom 106 of the machine, but it is to be understood that both sides may be similarly constructed. Pins 222 that are part of the coupling device 102 of the machine extend through the bores 214 to hold the adapter subassembly 208 and vibratory plate compactor assembly 200 to the boom 106 of the machine 100. In some embodiments, the coupling device 102 may be a quick change coupling mechanism but this might not be the case for other embodiments. In some cases, the assembly 200 may be permanently attached to the machine 100.

Now referring to FIGS. 2 and 3, the vibratory plate compactor assembly 200 comprises an upper portion 224, a lower portion 226 that is movably attached to the upper portion 224 and that includes a compacting plate 244, a vibration mechanism 202 operatively associated with the lower portion 226 for vibrating the lower portion 226, a plurality of isolation mounts 240 and a hydraulic hose 120' that runs from the manifold 206, which is attached to the remote side of the upper portion 224 of the compactor 200 that does not move, to the vibration mechanism 202 that is on the lower portion 226 of the compactor 200 that does move. The vibration mechanism 202 is supported in the bores of the support plates 230 of the lower portion 226. As mentioned previously, this vibration mechanism includes an eccentric mass that is coupled to the shaft via a spline, key or other type of coupling device that is prone to wear out, leading to machine downtime and maintenance costs.

SUMMARY OF THE DISCLOSURE

A mechanism is provided comprising a housing; a long shaft extending from the housing in opposite directions and a first gear disposed in the housing attached to the long shaft, a short shaft and a second gear attached to the short shaft, the second gear meshing with the first gear. A first axle portion surrounds the long shaft and a second axle portion surrounds the long shaft, wherein the first axle portion and the second axle portion extend from the housing in opposite directions. A yoke bushing member defining an outer perimeter having a figure eight configuration, a first aperture and a second aperture that are spaced away from each other a predetermined distance is also provided. The long shaft is disposed in the first aperture of the yoke bushing member and the short shaft is disposed in the second aperture and the long shaft is longer than the short shaft.

A vibratory plate compactor assembly is provided comprising an upper portion, a lower portion that is movably attached to the upper portion and that includes a compacting plate, a first support plate defining a first bore, and a second support plate defining a second bore and a vibration mechanism operatively associated with the lower portion for vibrating the lower portion. The mechanism includes a rotating housing, a stationary shaft defining a first free end and a second free end, a first axle portion extending from the rotating housing and defining a first central bore and a first free end, a second axle portion extending from the rotating housing and defining a second central bore and a second free end. The stationary shaft is disposed in the first and the second central bores and the first free end of the stationary shaft extends past the free end of the first axle portion and the second free end of the stationary shaft extends past the second free end of the second axle portion.

DETAILED DESCRIPTION

Figure 1:
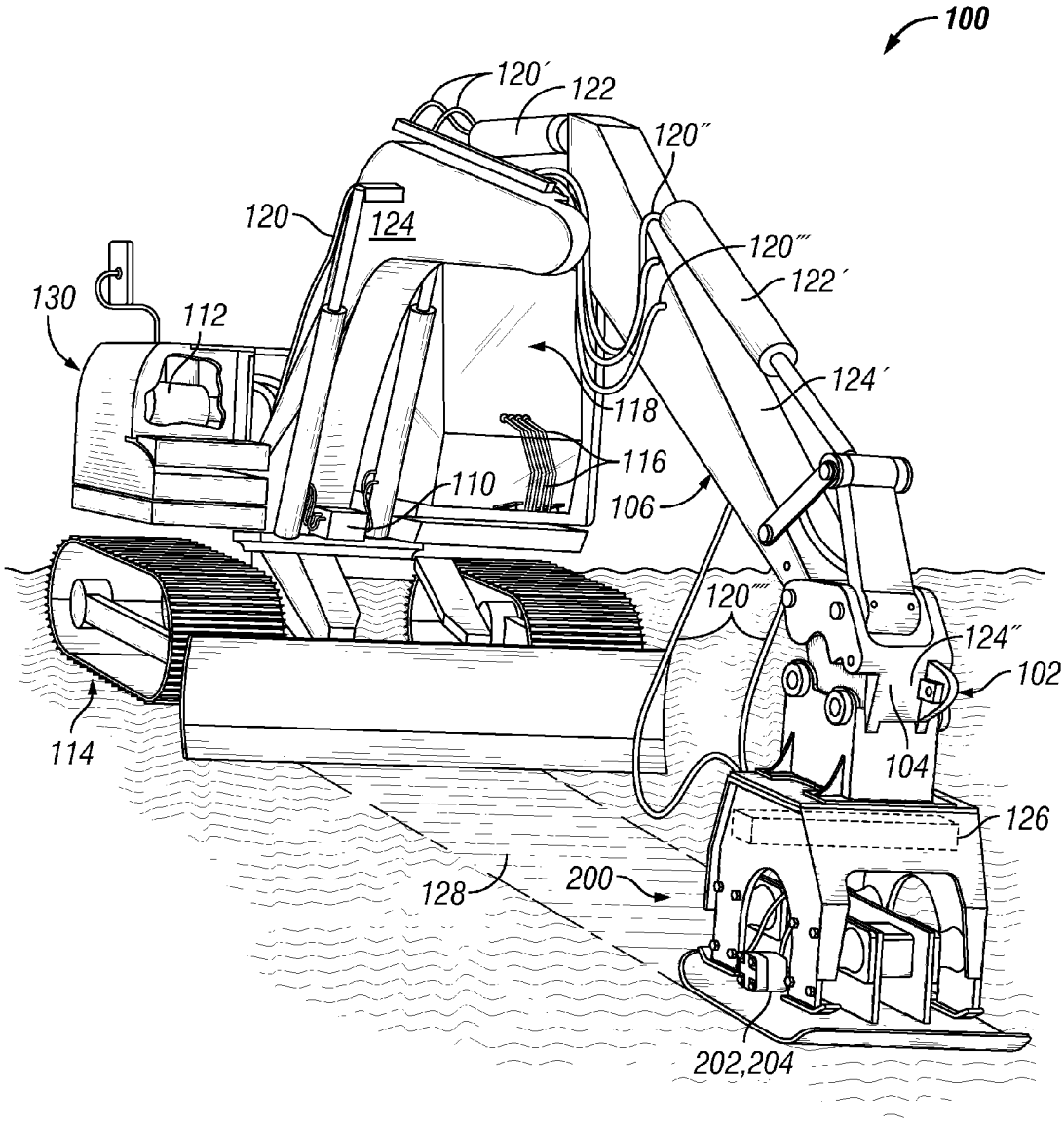
FIG. 1 (Prior Art)
FIG. 1 is a perspective view of a machine using a vibratory plate compactor assembly as known in the art.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

This disclosure provides various embodiments of a mechanism that eliminates the need for a spline, key or other coupling device to connect an eccentric mass to a shaft. While the mechanism is useful as a vibration mechanism, other uses are possible as will be described herein. Also, various modifications to the construction of the mechanism are possible and will be described. Initially, the mechanism will be described from the outside of the mechanism toward the inside of the mechanism. The mechanism will then be described starting with the inside of the mechanism toward the outside of the mechanism.

Looking at FIGS. 4 thru 7, a mechanism 300 according to an embodiment of the present disclosure is shown. The mechanism 300 includes a rotating housing 302, and a stationary shaft 304 defining a radial direction R304 and a cylindrical axis A304, a first free end 306 and a second free end 308 disposed along the axis A304. The rotating housing 302 is so called as it may rotate about the axis A304 of the stationary shaft 304 as will be described later herein. A first axle portion 310 extends from the rotating housing 302 and defines a first central bore 312 and a first free end 314 while a second axle portion 316 extends from the other side of the housing 302, defining a second central bore 318 and a second free end 320. The stationary shaft 304 is disposed in the first and the second central bores 312, 318 and the first free end 306 of the stationary shaft 304 extends past the free end 314 of the first axle portion 310 and the second free end 308 of the stationary shaft 304 extends past the second free end 320 of the second axle portion 316. Accordingly, the first and second axle portions are concentric with the stationary shaft and with each other.

Figure 5:
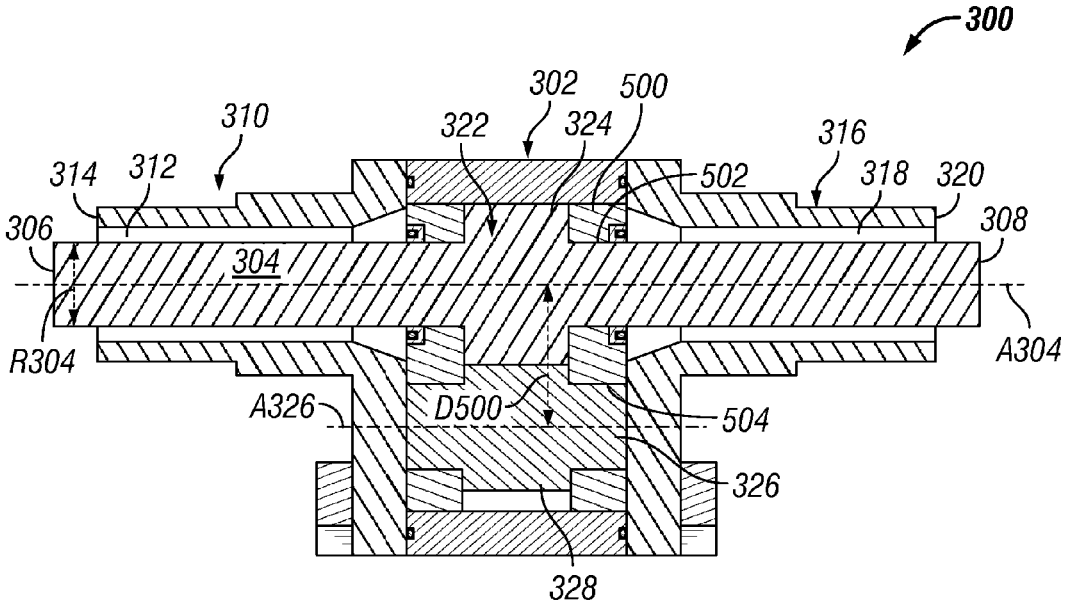
FIG. 5 is a side cross-sectional view of the rotating hydraulic gear motor of FIG. 4 taken along lines 5-5 thereof, illustrating the flow of hydraulic fluid to the gear motor housing chamber.
Figure 6:
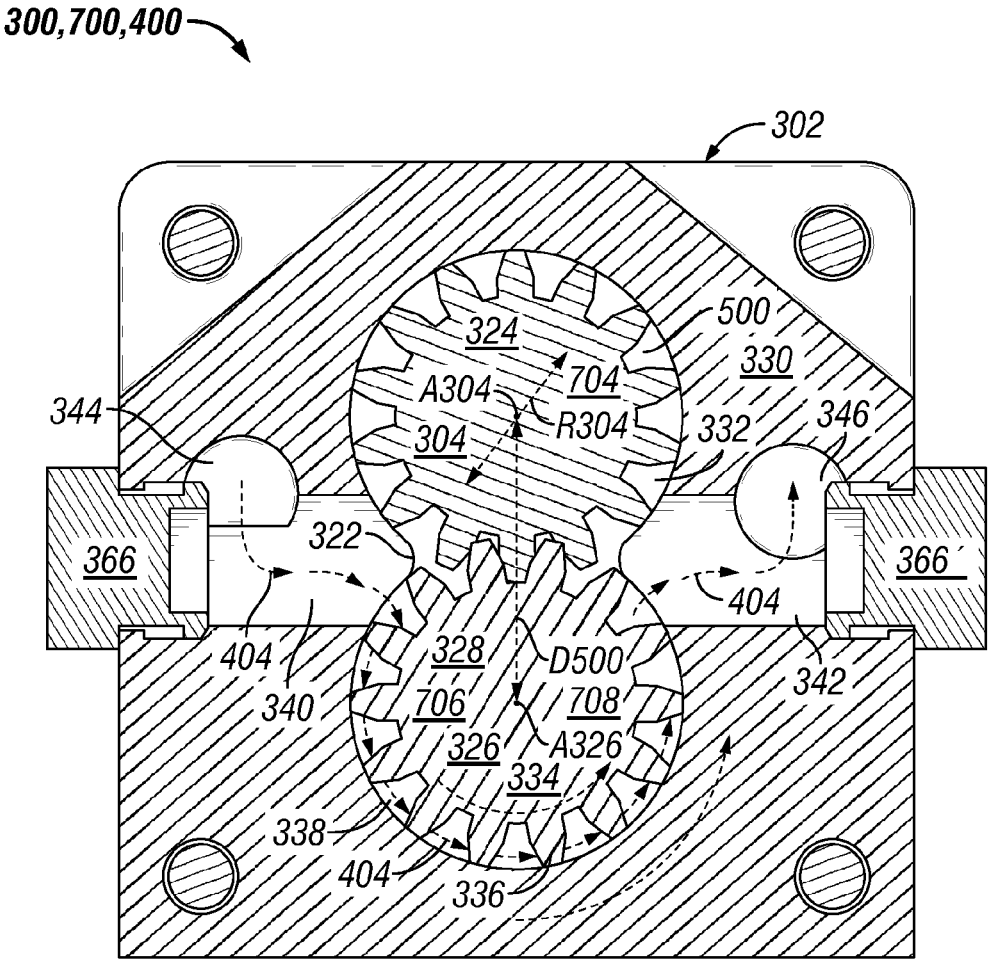
FIG. 6 is a front cross-sectional view of the rotating hydraulic gear motor of FIG. 4 taken along lines 6-6 thereof, showing the circulation of hydraulic fluid through the annular channel between the rotating gear and the housing, causing the gear to rotate.
Figure 7:
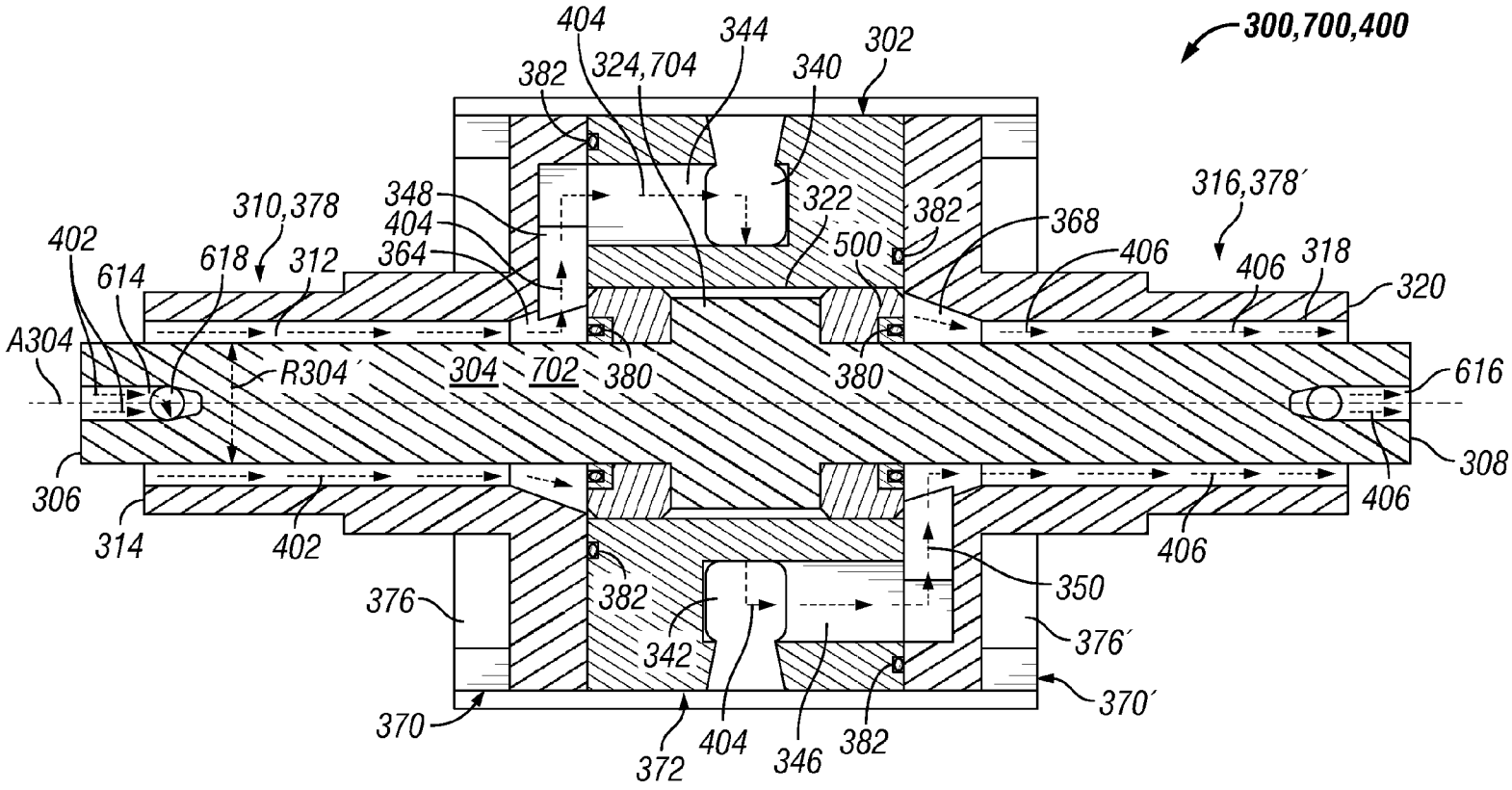
FIG. 7 is a top cross-sectional view of the rotating hydraulic gear motor of FIG. 4, taken along lines 7-7 thereof, illustrating the flow of hydraulic fluid from the hydraulic fluid inlet, to the housing chamber where flows causing the gear to rotate, eventually passing past the rotating gear to an outlet channel that leads to the hydraulic fluid outlet.

As best seen in FIGS. 5 thru 7, the housing 302 defines a housing chamber 322 and the mechanism 300 further comprises a fixed gear 324 attached to the stationary shaft 304, a rotating shaft 326 and a planetary gear 328 attached to the rotating shaft 326, the planetary gear 328 meshing with the fixed gear 324. A yoke bushing member 500 is provided, defining a first aperture 502 and a second aperture 504 that are spaced away from each other a predetermined distance D500, wherein the stationary shaft 304 is disposed in the first aperture 502 of the yoke bushing member 500 and the rotating shaft 326 is disposed in the second aperture 504. The yoke bushing member 500, the rotating shaft 326, the fixed gear 324, the planetary gear 328 and a portion of the fixed shaft 304 are disposed in the housing chamber 322.

Focusing on FIG. 6, the rotating shaft 326 defines an axis of rotation A326 and a plane 330 perpendicular to the axis A326 and a portion of the housing chamber 322 defines a perimeter 332 in the plane 330 that has a substantially figure eight configuration. The rotating planetary gear 328 comprises a hub 334 and teeth 336 extending from the hub 334, wherein the teeth 336 are disposed adjacent a portion of the perimeter 332 of the housing chamber 322 with a small clearance therebetween, the hub portion 334 and the perimeter 332 of the housing chamber 322 defines an annular channel 338.

Looking at FIGS. 6 and 7 together, the housing 302 defines a first bore 340 that extends from the housing chamber 322 in a first direction perpendicular to the axis A326 of the rotating shaft 326 and the housing 302 further defines a second bore 342 that extends from the housing chamber 322 in a second direction that is opposite the first direction. The housing 302 further defines a third bore 344 extending in a third direction that is parallel to the axis A326 of the rotating shaft 326 and a fourth bore 346 extending in a fourth direction that is opposite the third direction, wherein the third bore 344 is in fluid communication with the first bore 340 and the fourth bore 346 is in fluid communication with the third bore 344. Finally, the housing 302 further defines a fifth bore 348 that extends in the same direction as the second bore 342 and a sixth bore 350 that extends in the same direction as the first bore 340. The fifth bore 348 is in fluid communication with the third bore 344 and the sixth bore 350 is in fluid communication with the fourth bore 346. Lastly, the fifth bore 348 is in fluid communication with the central bore 312 of the first axle portion 310 while the sixth bore 350 is in fluid communication with the central bore 318 of the second axle portion 316.

Figure 4:
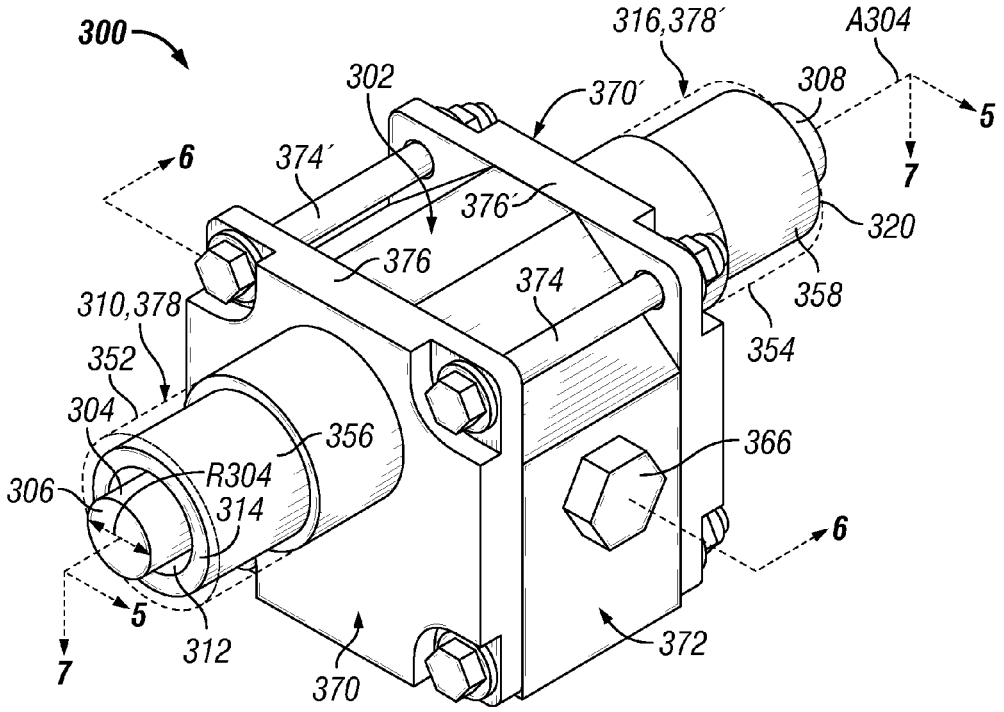
FIG. 4 is a perspective view of a vibration mechanism using a rotating hydraulic gear motor according to an embodiment of the present disclosure, showing the hydraulic fluid inlet.

Referring now to FIG. 4, the mechanism may further comprise a first support bearing 352 and a second support bearing 354. The first axle portion 310 may define a first outer circumference 356 and the second axle portion 316 defines a second outer circumference 358. The first support bearing 352 may be disposed about the first outer circumference 356 spaced away along the axis A304 from the housing 302 and the second support bearing 354 may be disposed about the second outer circumference 358 spaced away from the housing 302 along the axis A304.

Figure 2:
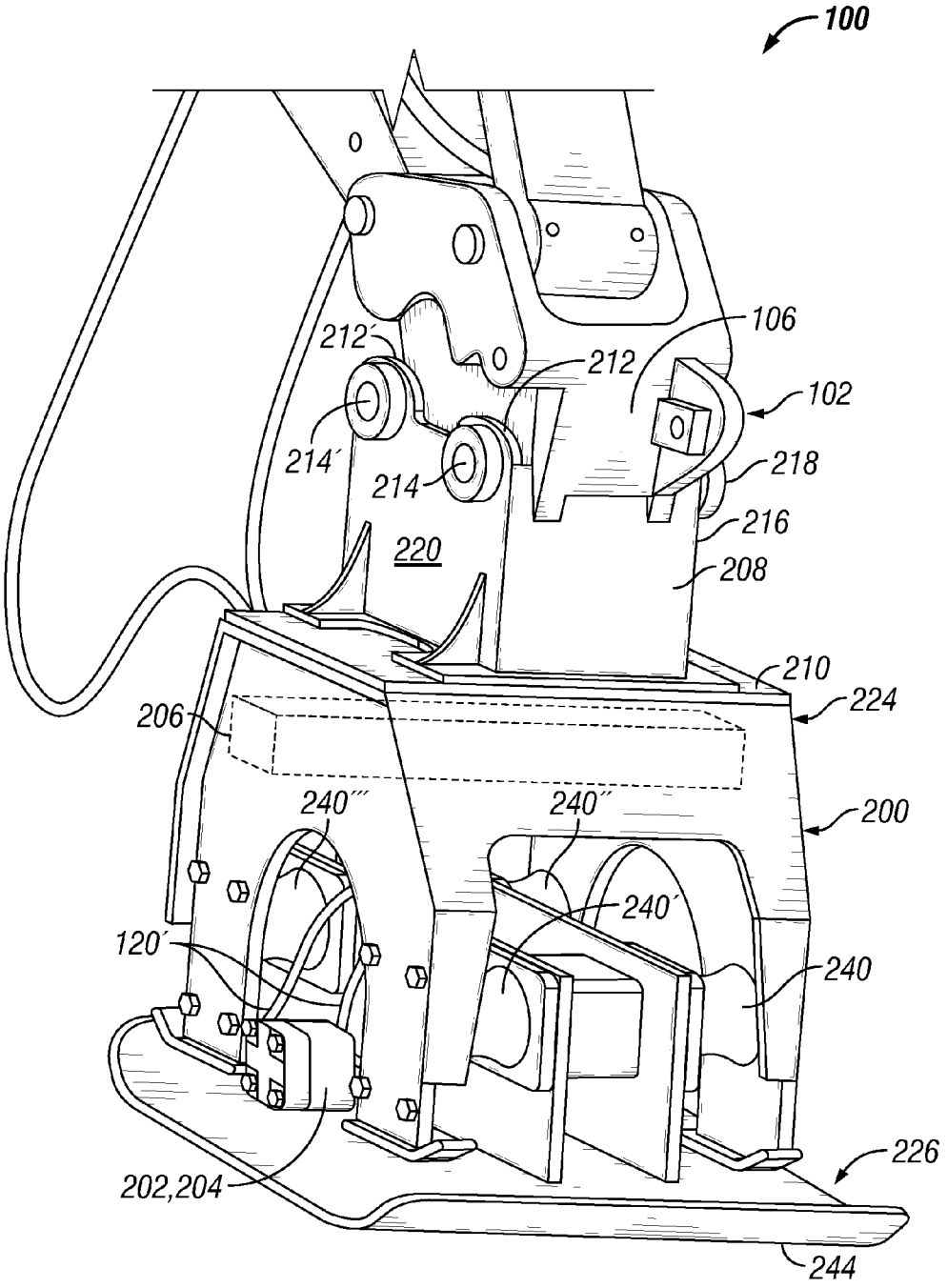
FIG. 2 (Prior Art)
FIG. 2 is an enlarged detail view of the vibratory plate compactor assembly connected to the boom of the machine of FIG. 1.
Figure 3:
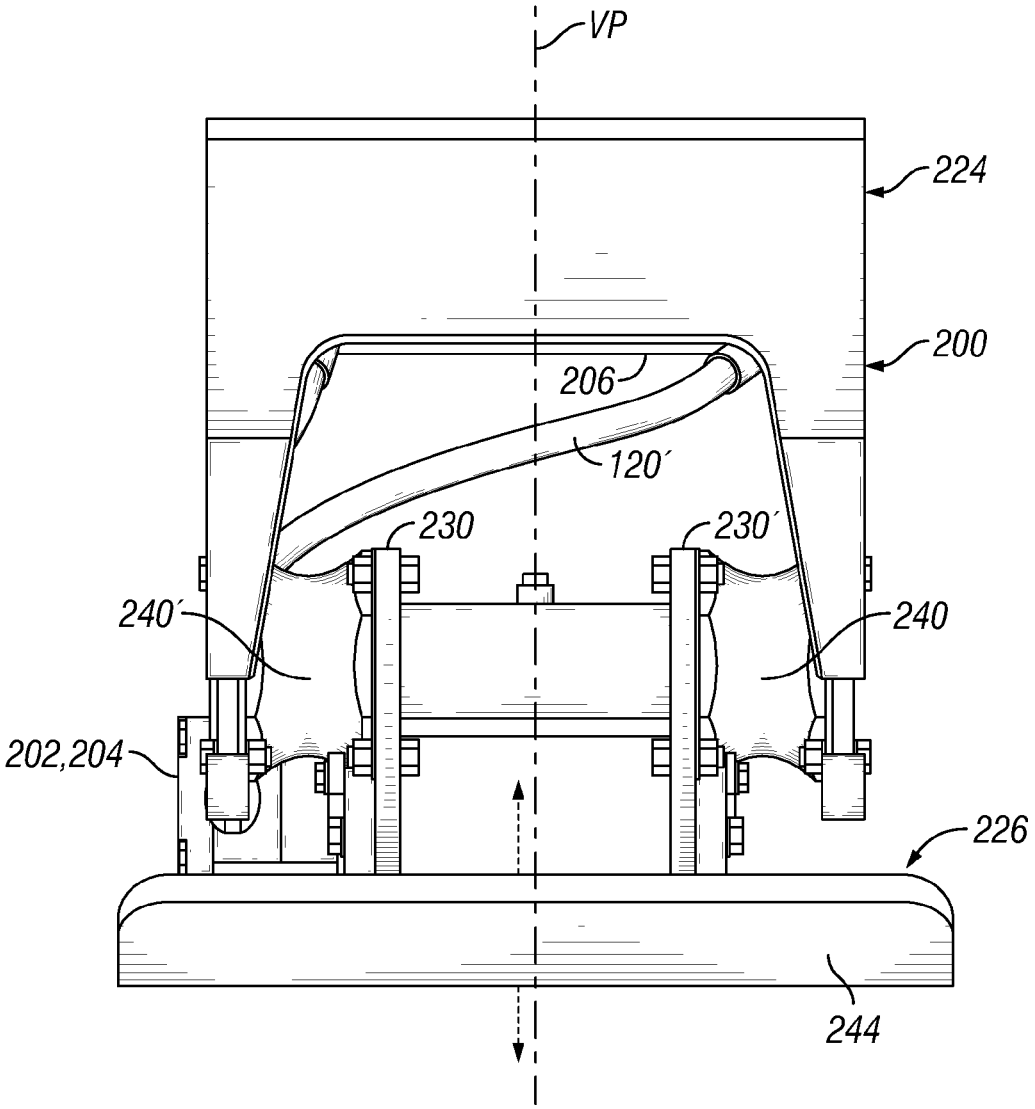
FIG. 3 (Prior Art)
FIG. 3 is a front view of the compactor assembly of FIG. 2, removed from the boom of the machine, better illustrating how the vibration mechanism is supported by support plates of the compactor assembly.

When the mechanism 300 is employed as a vibration mechanism 602, it may be attached to a vibratory plate compactor assembly 600, such as that disclosed in FIG. 2. It is to be understood that in some applications, the construction of the vibratory plate compactor assembly may need to be adjusted to accommodate the new mechanism. A new vibratory plate compactor assembly 600 using a vibration mechanism 602 according to an embodiment of the present disclosure may be described as follows with reference to FIGS. 2 and 8. The assembly 600 may comprise an upper portion 224 and a lower portion 226 such as that shown in FIG. 2. As such, the lower portion 226 is movably attached to the upper portion 224 and includes a compacting plate 244.

Figure 8:
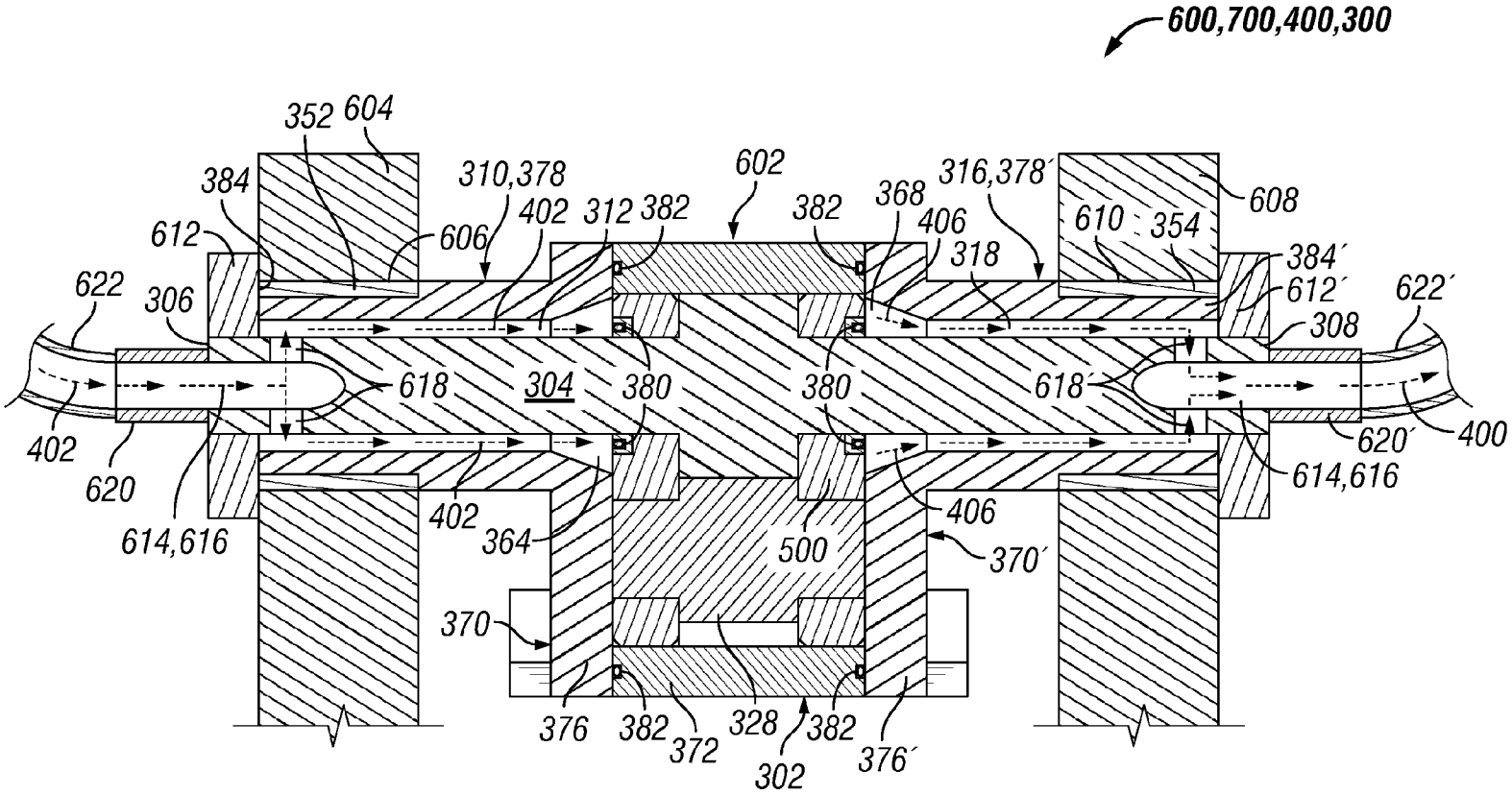
FIG. 8 is the same view as FIG. 5 except the flow of the hydraulic fluid from the housing chamber to the hydraulic fluid outlet is shown.

As best seen with reference to FIG. 8, a first support plate 604 defining a first bore 606, and a second support plate 608 defining a second bore 610 are provided. The support bearings 352, 354 and axle portions 310, 316 are inserted into this structure for proper support. A flag plate 612 is welded or fastened onto a free end 306, 308 of the stationary shaft 304 and bolted to a support plate 604, 608, preventing the shaft 304 from moving. A hydraulic inlet 614 or outlet 616 may be provided that is drilled into the end 306, 308 of the shaft 304 and connected to the central bore 312, 318 via cross-bores 618 in the shaft 304. A fitting 620 may be attached to the shaft 304 from which a fluid conduit 622 may be connected to allow the flow of hydraulic fluid. The movement of the fluid causes the housing 302 to rotate, causing the plate 244 to move up and down. Hence, the vibration mechanism 602 is operatively associated with the lower portion 226 (see FIG. 2) for vibrating the lower portion 226. The exact manner in which the mechanism 602 provides this vibration will be described later herein.

Referring back to FIGS. 6 and 7, a mechanism 700 according to another embodiment of the present disclosure may be described in more general terms as follows. The mechanism 700 comprises a long shaft 702 and a first gear 704 attached to the long shaft 702, a short shaft 706 and a second gear 708 attached to the short shaft 706. The second gear 708 meshes with the first gear 704. There is a yoke bushing member 500 defining a first aperture 502 and a second aperture 504 that are spaced away from each other a predetermined distance D500 and the long shaft 702 is disposed in the first aperture 502 of the yoke bushing member 500 and the short shaft 326 is disposed in the second aperture 504. When used in a compactor assembly, the rest of this mechanism may be described in a similar manner as mechanism 300. That is to say, the construction of the housing 302 and the axle portions 310, 316 are the same as has been described regarding mechanism 300. The housing chamber 322 contains the yoke bushing member 500, the short shaft 706, the first gear 704, the second gear 708 and a portion of the long shaft 702. Also, the hydraulic circuit is essentially the same.

More particularly, the same network of bores establishes a hydraulic circuit that allows the fluid to flow through the first axle portion 310, to the housing chamber 322 causing the second gear 708 to rotate about the first gear 704, which in turn, causes the housing 302 to rotate about the axis A304 of the long shaft 702. Then, the hydraulic fluid exits the housing 302 through the second axle portion 316.

Figure 9:
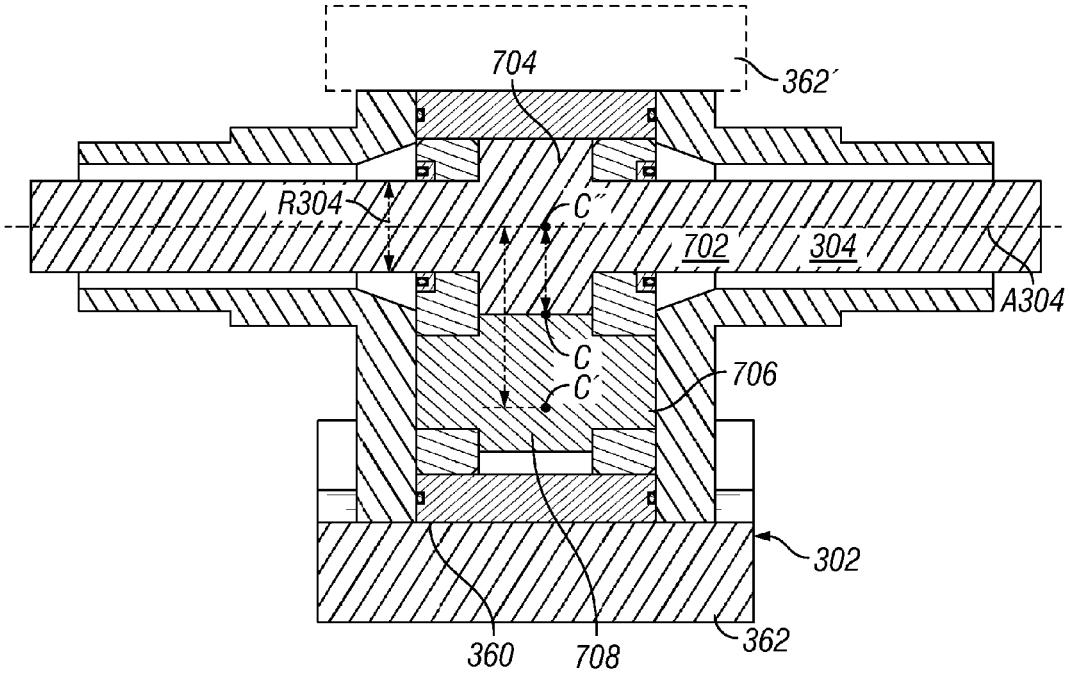
FIG. 9 is the same view as FIG. 5 or 7 except an extra eccentric mass has been added to the radial extremity of the motor housing to enhance the amount of vibration created as the housing rotates about the fixed shaft.

When the mechanism is used as a vibration mechanism as shown in FIG. 9, the long shaft 702 is a stationary shaft, the first gear 704 is a fixed gear, the short shaft 706 is a rotating shaft, the second gear 708 is a planetary gear, and the stationary shaft 304 defines a radial direction R304 and an axis A304, wherein the mechanism defines a center of mass C that is spaced away from the axis A304 of the stationary shaft 304 along the radial direction R304. As a result, the rotation of the housing 302 causes the compactor plate to move up and down. The housing 302 defines a radial extremity 360 and the mechanism may further comprise an eccentric mass 362 attached proximate the radial extremity 360 via fastener, welding, etc. This moves the center of mass C' further down, increasing the propensity for the mechanism to vibrate the plate up and down. However, it is further contemplated that the eccentric mass 362' may be attached to the other side of the housing 302, closer to the axis of rotation A304, moving the center of mass C" nearer to or coincident with the axis of rotation A304, virtually eliminating the propensity of the mechanism to create vibrations.

INDUSTRIAL APPLICABILITY

In practice, a mechanism, a vibration mechanism or a vibratory plate compactor assembly according to any of the embodiments as discussed herein may be manufactured, sold or attached to a machine as described herein. This may be done in an aftermarket or OEM context, that is to say, the mechanism, vibration mechanism or vibratory plate compactor assembly may be sold originally with a machine or be attached to the machine later after the original purchase of the machine. Similarly, a machine may originally be equipped or configured to use any of the embodiments of a mechanism, vibration mechanism, or a vibratory plate compactor assembly as described herein or be retrofitted with the ability to use such assemblies. When not used to create vibration, the mechanism may be used to create a rotating or oscillating joint, etc.

It is contemplated that the yoke bushing member may be subject to wear and therefore need replacement. Therefore, the yoke bushing may be manufactured, sold or otherwise obtained to be supplied as a replacement part.

Figure 10:
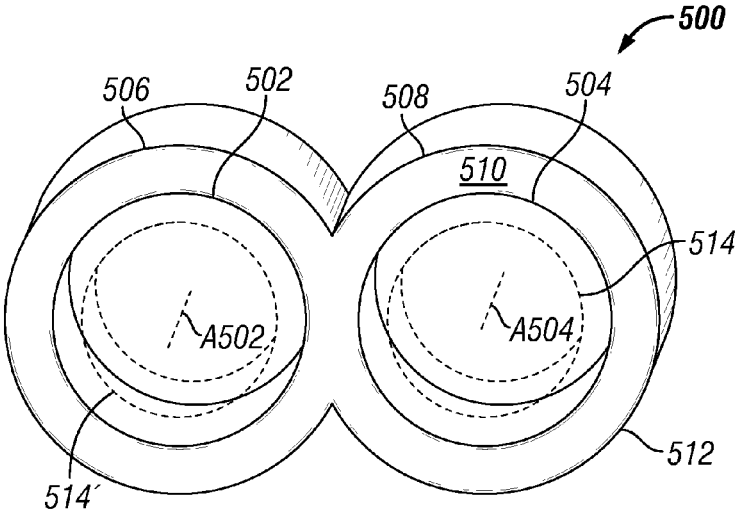
FIG. 10 is a perspective yoke bushing member according to an embodiment of the present disclosure.

FIG. 10 illustrates the yoke bushing member 500 shown in isolation from any mechanism or assembly. As shown, the yoke bushing member 500 comprises a first yoke portion 506 defining a first cylindrical bore 502 that defines a first cylindrical axis A502 and a second yoke portion 508 defining a second cylindrical bore 504 that defines a second cylindrical axis A504. The second yoke portion 508 is connected to the first yoke portion 506 and the axes A502, A504 are parallel. The yoke bushing member 500 defines a plane 510 perpendicular to the cylindrical axes A502, A504, and the first and the second yoke portions 506, 508 of the yoke bushing member 500 defining an outer perimeter 512 in the plane 510 that has a substantial figure eight configuration. Hence, the yoke bushing member 500 is complimentary shaped to the perimeter 332 of the housing chamber 322 to fit snugly therein (see FIG. 6).

In some embodiments, the yoke bushing member comprises a bronze material. A bearing 514 may be pressed into either cylindrical bore.

A particular hydraulic circuit 400 will now be described with reference to FIGS. 6-8 that is compatible with any of the assemblies or mechanisms described herein. It is to be understood that the manifold of the compactor assembly receives pressurized fluid from the machine through hydraulic hoses shown in FIGS. 1 and 2 as previously described herein. Conduits then convey the fluid to the mechanism and back from the mechanism.

An exemplary hydraulic circuit 400 could begin with stage one flow (see arrows 402 in FIGS. 7 and 8) as the hydraulic fluid flows through conduit 622 and enters the fitting 620 into a hydraulic inlet channel 614. The fluid then passes through the cross-bore 618 and into the central bore 312 of the first axle portion 312. The fluid would continue to flow down this bore 318 until it reaches a diverging channel 364 just before the flow enters the housing 302. At the diverging channel 364, the flow would slow down, helping to facilitate the powering of the planetary gear 328 once the flow reaches it. This ends stage one of the flow.

Stage two flow (see arrows 404 in FIGS. 6 and 7) begins as the fluid enters the fifth bore 348, transitions to the third bore 344, and enters the first bore 340. As best seen in FIG. 6, the flow is forced toward the gears 324, 328 because the first bore 340 is sealed by a plug 366. As the flow approaches the fixed gear 324, the flow would push on the teeth of the fixed gear 324 with no effect as the fixed gear 324 is prevented from moving due to the attachment of the flag plate 612 to the stationary shaft 304 and the support plate 604. For this embodiment, the shaft 304 is integral with the fixed gear 324, preventing its movement as well. However, the fluid pressure would also press on the teeth 336 of the planetary gear 328, forcing movement of the gear and teeth in a counterclockwise direction, causing the planetary gear 326 to crawl about the fixed gear 324. This causes the housing 302 to also rotate about axis A304 in the same direction. Movement upwards of the housing causes the compacting plate to move up while movement downward causes the compacting plate to move downward. The fluid 404 passes through the annular channel 338 until it reaches the second bore 342. At that time, the flow 404 would enter the fourth bore 346 into the sixth bore 350 just before reaching the converging channel 368, increasing the speed of the flow. This would end the second stage of the flow.

Stage three flow (see arrows 406 in FIGS. 7 and 8) begins as the fluid enters the converging section 368 of the central bore 318 of the second axle portion 316. This converging section speeds up the flow of the hydraulic fluid. The fluid passes along this bore 318 until it reaches the cross-bores 618' and enters into the hydraulic outlet 616. It then flows out the fitting 620' and conduit 622' and returns back to the manifold.

Of course, it is contemplated that the flow of this hydraulic circuit could be reversed in other embodiments. Additionally, other circuits that use the embodiments of a mechanism or assembly as described herein could be created as needed or desired. Furthermore, other fluids other than hydraulic fluid could be used such as air, oil, etc. It is also contemplated that the flow could be periodically reversed to create an oscillating motion of the housing, etc.

Referring now to FIGS. 4, 7 and 8, a particular construction and manner of assembling the mechanism 300 will now be explained. The exterior of the mechanism 300 is formed by two identically configured cap members 370 that sandwich a core member 372 between them. The cap members 370 are attached to each other using tie rods 374 in a manner known in the art. The cap members 370 include and end plate 376 and a tube structure 378 extending from the end plate 376 that forms the axle portion 310, 316 of the mechanism 300. The tube structure 378 is integral with the end plate 376 being machined from the same component or being cast together. The core member 372 defines the housing chamber 322 and may also be machined from a single component or be cast.

As best seen in FIGS. 7 and 8, a first set of seals 380 are disposed between the stationary shaft 304 and the yoke bushing member 500 to help prevent fluid from bypassing the central chamber 332 by escaping along the shaft 304. This would decrease the power output of the mechanism. A second set of seals 382 are disposed between the cap members 370 and the core member 372 to prevent fluid from passing between them. Although not shown in FIG. 8, face seals may be disposed at the interface 384 between the rotating axle portions 310, 316 and the support plates 604, 608. This would allow movement between the axle portions and the support plates while still preventing fluid from leaking between these components.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the disclosure(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A vibratory plate compactor assembly comprising:

an upper portion;

a lower portion that is movably attached to the upper portion and that includes a compacting plate, a first support plate defining a first bore, and a second support plate defining a second bore;

a vibration mechanism operatively associated with the lower portion for vibrating the lower portion; the mechanism including a rotating housing;

a stationary shaft defining a first free end and a second free end;

a first axle portion extending from the rotating housing and defining a first central bore and a first free end;

a second axle portion extending from the rotating housing and defining a second central bore and a second free end; and wherein the stationary shaft is disposed in the first and the second central bores and the first free end of the stationary shaft extends past the free end of the first axle portion and the second free end of the stationary shaft extends past the second free end of the second axle portion.

2. The assembly of claim 1 further comprising a first support bearing and a second support bearing, wherein the first axle portion defines a first outer circumference and the second axle portion defines a second outer circumference, and wherein the first support bearing is disposed about the first outer circumference spaced away from the housing and the second support bearing is disposed about the second outer circumference spaced away from the housing.

3. The assembly of claim 2 wherein the housing defines a housing chamber, the assembly further comprising:

a fixed gear attached to the stationary shaft;

a rotating shaft and a planetary gear attached to the rotating shaft, the planetary gear meshing with the fixed gear; and a yoke bushing member defining a first aperture and a second aperture that are spaced away from each other a predetermined distance, wherein the stationary shaft is disposed in the first aperture of the yoke bushing member and the rotating shaft is disposed in the second aperture.

4. The assembly of claim 3 wherein the yoke bushing member, the rotating shaft, the fixed gear, the planetary gear and a portion of the stationary shaft are disposed in the housing chamber.

5. The assembly of claim 4 wherein the rotating shaft defines an axis of rotation and a plane perpendicular to the axis and a portion of the housing chamber defines a perimeter in the plane that has a substantially figure eight configuration.

6. The assembly of claim 5 wherein the planetary gear comprises a hub and teeth extending from the hub, wherein the teeth are disposed adjacent a portion of the perimeter of the housing chamber with a small clearance therebetween, the hub portion and the perimeter of the housing chamber defining an annular channel.

7. The assembly of claim 6 wherein the housing defines a first bore that extends from the housing chamber in a first direction perpendicular to the axis of the rotating shaft, the housing further defining a second bore that extends from the housing chamber in a second direction that is opposite the first direction; and wherein the housing further defines a third bore extending in a third direction that is parallel to the axis of the rotating shaft and a fourth bore extending in a fourth direction that is opposite the third direction, wherein the third bore is in fluid communication with the first bore and the fourth bore is in fluid communication with the third bore; and wherein the housing further defines a fifth bore that extends in the same direction as the second bore, the housing further defining a sixth bore that extends in the same direction as the first bore, wherein the fifth bore is in fluid communication with the third bore and the sixth bore is in fluid communication with the fourth bore.

8. The assembly of claim 3 comprising:

a first yoke portion defining the first aperture that defines a first cylindrical axis; and a second yoke portion defining the second aperture that defines a second cylindrical axis, the second yoke portion being connected to the first yoke portion;

wherein the yoke bushing member defines a plane perpendicular to the cylindrical axes, the first and the second yoke portions of the yoke bushing member defining an outer perimeter in the plane that has a substantial figure eight configuration.

9. The assembly of claim 8 wherein the yoke bushing member comprises a bronze material.

10. The assembly of claim 8 further comprising a bearing that is pressed into either aperture.

* * * * *